US007004468B2

(12) United States Patent
Johnson et al.

(10) Patent No.: US 7,004,468 B2
(45) Date of Patent: Feb. 28, 2006

(54) THROWING GAME

(76) Inventors: Gary Johnson, 20486 Whistlepunk, Bend, OR (US) 97702; Joe Lessard, 22278 Charing Cross Road, Chatnan (CA) N7M 5H8

( * ) Notice: Subject to any disclaimer, the term of this patent is extended or adjusted under 35 U.S.C. 154(b) by 0 days.

(21) Appl. No.: 10/982,227

(22) Filed: Nov. 3, 2004

(65) Prior Publication Data

US 2005/0134000 A1 Jun. 23, 2005

Related U.S. Application Data

(60) Provisional application No. 60/517,116, filed on Nov. 3, 2003.

(51) Int. Cl.
*A63B 63/00* (2006.01)

(52) U.S. Cl. ..... 273/343

(58) Field of Classification Search ..... 273/348, 273/331, 343, 336, 359, 368
See application file for complete search history.

(56) References Cited

U.S. PATENT DOCUMENTS

| | | | | |
|---|---|---|---|---|
| 2,797,924 | A * | 7/1957 | Stewart | 273/343 |
| 3,315,963 | A * | 4/1967 | Masters | 273/343 |
| 3,774,911 | A * | 11/1973 | Benfield | 273/343 |
| 5,165,694 | A * | 11/1992 | Kraushaar | 273/343 |
| 6,308,956 | B1 * | 10/2001 | Reid | 273/343 |
| 6,695,698 | B1 * | 2/2004 | Anghelo et al. | 463/25 |
| 6,773,014 | B1 * | 8/2004 | Lynch | 273/343 |
| 6,773,015 | B1 * | 8/2004 | Long et al. | 273/343 |
| 2002/0084588 | A1 * | 7/2002 | Lynch | 273/343 |
| 2004/0135318 | A1 * | 7/2004 | Long et al. | 273/343 |
| 2005/0017455 | A1 * | 1/2005 | Long et al. | 273/343 |
| 2005/0082761 | A1 * | 4/2005 | Lynch | 273/343 |
| 2005/0134000 | A1 * | 6/2005 | Johnson et al. | 273/343 |

* cited by examiner

*Primary Examiner*—Raleigh W. Chiu

(57) ABSTRACT

A game including a frame, a rotatable scoring assembly, and at least one playing piece. The at least one playing piece is thrown toward the rotatable scoring assembly, and points are scored by the playing piece coming to rest on predetermined portions of the scoring bar assembly.

14 Claims, 3 Drawing Sheets

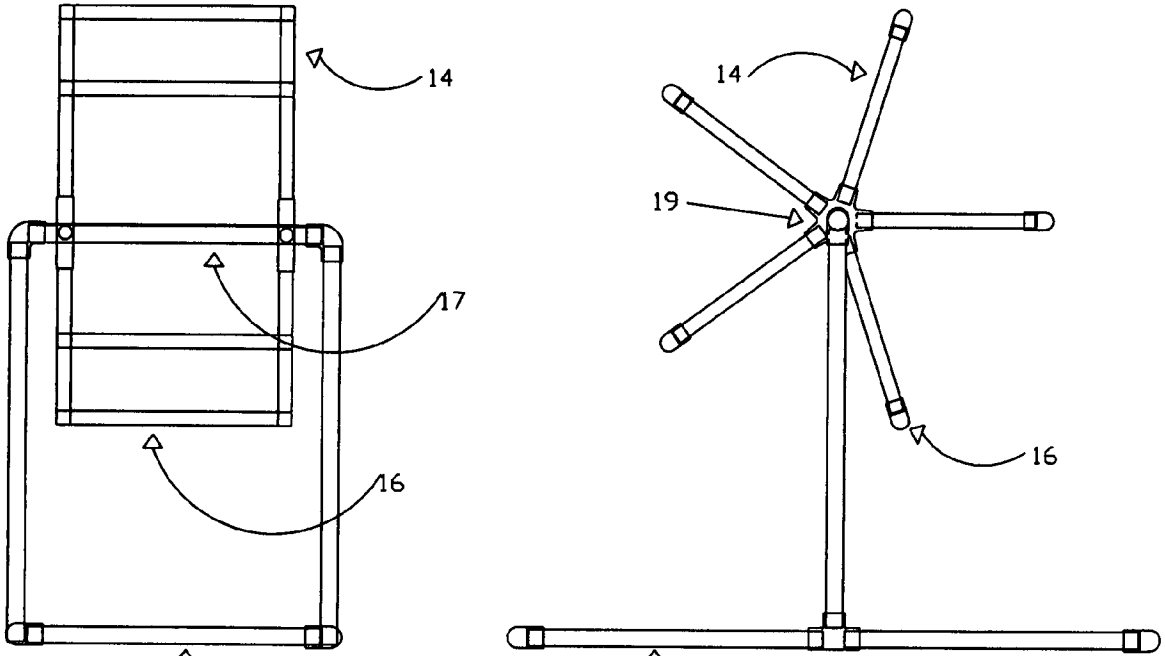
Fig. 2
Fig. 3
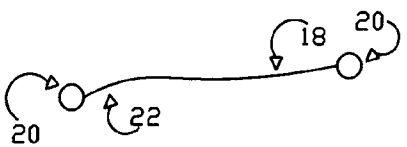
Fig. 5

THROWING GAME

RELATED APPLICATION

This application claims priority to U.S. 60/517,116 filed Nov. 3, 2003.

BACKGROUND OF THE INVENTION

This invention relates to a game in which each player throws one or more playing pieces toward a target.

BRIEF DESCRIPTION OF THE DRAWINGS

FIG. 2 is a front view of the embodiment shown in FIG. 1.

FIG. 3 is a side view of a second embodiment of the invention.

FIG. 5 is a top plan view of a scoring card for one embodiment of the invention.

DESCRIPTION OF THE PREFERRED EMBODIMENTS OF THE INVENTION

Figure 1:
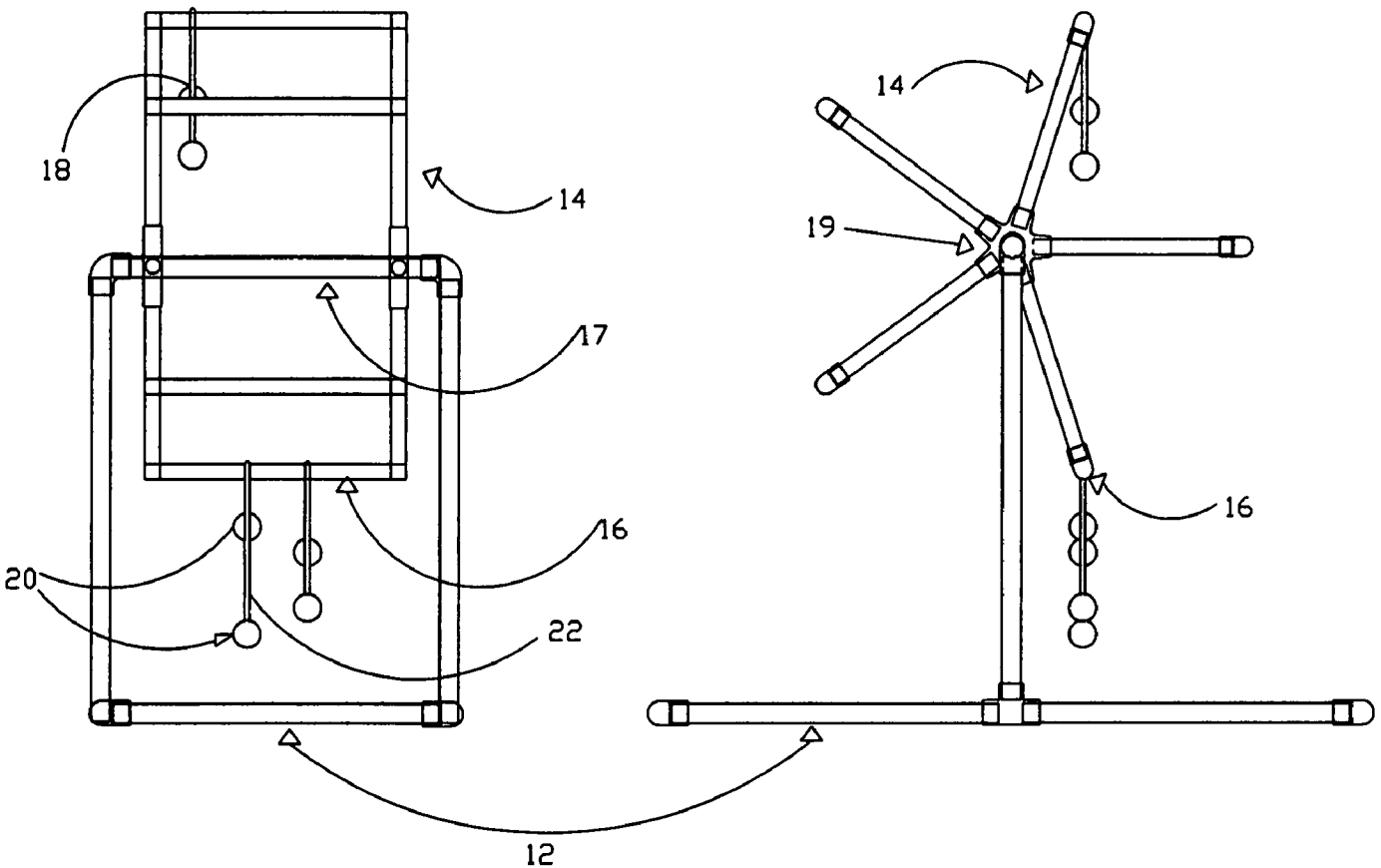
FIG. 1 is a perspective view of a game according to the preferred embodiment of the invention.
Figure 4:
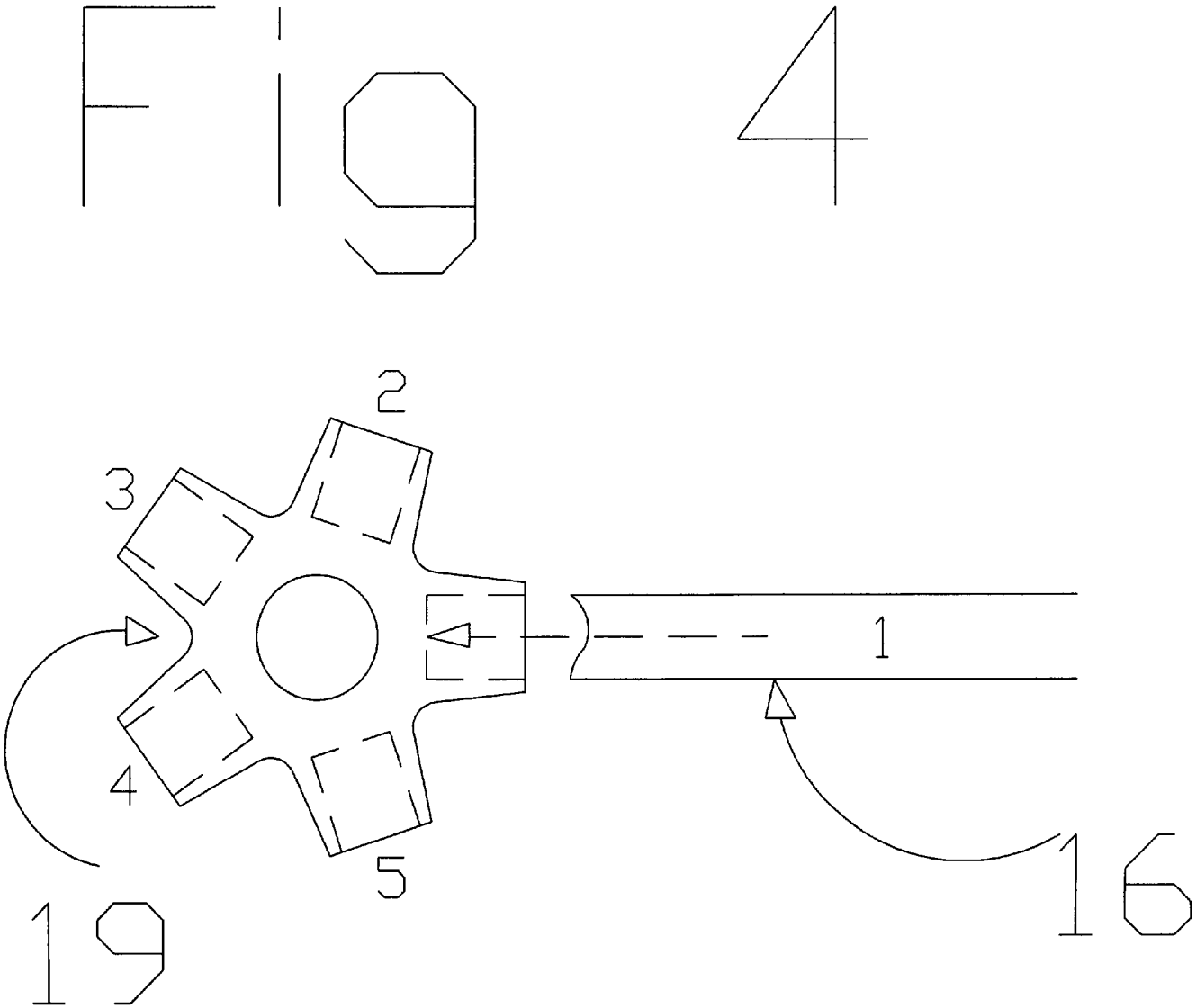
FIG. 4 is an enlarged partial exploded view of the embodiment shown in FIG. 3.

Referring now to the drawings, in preferred embodiments the game of this invention is played by placing a pair of targets 10 some distance apart. Each target consists of a frame 12 and a scoring wheel 14 that is rotatably mounted on the frame 12. Scoring wheel 14 includes a plurality of lateral scoring bars 16. Each scoring bar 16 is assigned a point value. In the preferred embodiment that is illustrated in FIG. 1, there are six scoring bars, including the center scoring bar 17 that also serves as the axle for the rotating scoring wheel. The invention is not limited to any specific number of bars, which in other embodiments could vary in number. The frame 12 and rotatable scoring wheel assembly 14 are preferably formed from readily available plastic 10 pipe and fittings, and in the preferred embodiment can be partially disassembled for easy storage and transportation. Referring to FIG. 4, in one preferred embodiment the scoring bars 16 are mounted onto the center scoring bar 17 using a hub assembly 19 as shown.

In one embodiment, the game is played by spacing a pair of targets 10 a predetermined distance apart with the lateral scoring bars oriented transversely to an imaginary line between the targets. While standing near one target, each player in turn throws a number of playing pieces 18 toward the other target. Each playing piece 18 consists of a pair of balls 20 connected by a short piece of string or rope 22. The object of the game is to score points by causing the player's playing pieces to come to rest on a lateral scoring bar, and to accumulate the greatest number of points. Referring again to FIG. 1, if the playing piece lands and remains on a lateral scoring bar 16, the player is awarded the corresponding number of points. In another preferred embodiment, the scoring is similar to bowling. While the rules of play will now be described in greater detail by reference to the following examples, the invention is not intended to be limited to the examples described, or to any particular materials or details of construction.

EXAMPLE 1

The targets are placed 25 feet apart and offset so the players can throw straight on toward each target. If playing with 2 to 3 players, each player throws toward one target, then they walk to that target and throw back toward the first target. For 4 or 6 players, there are two players on each team, and team members throw from opposite targets and remain in position there. A coin flip determines who initially goes first. Each turn thereafter the team with the highest score goes first. Each player or team has three playing pieces, and each throws one piece in turn. After each player has thrown the first playing piece, the sequence is repeated until each player has thrown all of their playing pieces. The throw must be made underhand holding on to one and only one ball. When throwing a playing piece a person must stay behind the front of the frame placed at the end from which they are throwing. As mentioned, in the preferred embodiment there are 6 scoring bars, 5 on the outside (1 black, 1 yellow, 1 orange, 1 green, 1 red), and one in the center (blue). The scoring bars are assigned the following point values: black=1 point, yellow=2 points, orange=4 points, green=6 points, red=minus 6 points, and blue=8 points.

At the end of a round, if there are an odd number of playing pieces on a bar, the playing pieces score the value of the bar. If there is an even number of playing pieces on a bar, then each playing piece on that bar scores zero. If a single player ends a turn with all three of their tosses on the same color (except the Red), the player scores an extra 10 points (even if there are an even number of playing pieces on a bar). In order to count, the rope of the playing piece has to be touching the central colored part of the scoring bar. If the rope is touching the colored part of more than one bar, the value of the bars are added together. If a player's playing piece gets tangled with another playing piece already on a bar, and their ball is off the ground and is not around the bar, it is scored as if the playing piece was on the bar. The first team to 30 wins. If two teams are both over 30 at the end of the round, the team with the highest number wins. In case of a tie, the teams tied play until one team leads at the end of a round.

EXAMPLE 2

In this embodiment the game is played using rules similar to bowling. This game is played with any number of players, and using one target for each player. If more players than targets, one player takes a turn, then clears the target for the next player. The target is placed 25 feet from the player, and each players in turn throws three playing pieces to complete each frame. Each player gets 10 turns. The bars on the target are numbered as follows black=1, yellow=2, orange=4, green=6, red=8, and blue=10. If a person throws two playing pieces on the same bar during their turn, the second playing pieces points are doubled, if they throw their third playing piece on the same bar, the points for the third playing piece is tripled. If the rope is touching the colored part of more than one bar, the value of the bars are summed. After each person has had ten turns, the scores are totaled and the person with the highest score wins. In this embodiment the score is kept using the score card shown in FIG. 6.

Those of skill in the art will recognize that numerous modifications are possible with respect to the apparatus as described and to the rules of play without departing from the scope of the invention.

What is claimed is:

1. A game comprising:

a frame;

a scoring bar assembly rotatably mounted on the frame, the scoring bar assembly including at least one transverse scoring bar each at Ieast one scoring bar having a predetermined point value;

at least one playing piece operable to fall onto and engage the at least one scoring bar; and, the scoring bar assembly operable to rotate responsive to said at least one playing piece falling thereon.

2. A game comprising:

a frame;

a scoring bar assembly rotatably mounted on the frame, the scoring bar assembly including at least one transverse scoring bar, each at least one scoring bar having a predetermined point value;

at least one playing piece operable to fall onto and engage the at least one scoring bar; and, wherein each at least one scoring bar further comprises a designated scoring section engageable by the playing piece.

3. A game according to claim 2 wherein said scoring bar assembly comprises a plurality of scoring bars, each said scoring bar having a predetermined scoring value.

4. A game according to claim 2 wherein the at least one scoring bar includes a central transverse scoring bar journaled into the frame, and about which the scoring bar assembly is rotatable.

5. A game according to claim 2 wherein the scoring bar assembly is rotatable responsive to a playing piece falling onto at least one scoring bar.

6. A game according to claim 2 wherein the at least one playing piece comprises spaced apart members connected by a flexible tether.

7. A game according to claim 6 wherein at least one of the spaced apart members comprises a ball.

8. A method of playing a game comprising:

providing a frame; a scoring bar assembly rotatably mounted on the frame, the scoring bar assembly including at least one transverse scoring bar, each at least one scoring bar having a predetermined point value; and at least one playing piece operable to fall onto and engage the at least one scoring bar;

placing the frame away from a player;

throwing the at least one playing piece toward the scoring bar assembly; and, awarding points based on whether the playing piece falls onto predetermined portions of the scoring bar assembly.

9. A method according to claim 8 wherein each at least one scoring bar further comprises a designated scoring section engageable by the playing piece.

10. A method according to claim 8 wherein said scoring bar assembly comprises a plurality of scoring bars, each said scoring bar having a predetermined scoring value.

11. A method according to claim 8 wherein the at least one scoring bar includes a central transverse scoring bar journaled into the frame, and about which the scoring bar assembly is rotatable.

12. A method according to claim 8 wherein the scoring bar assembly is rotatable responsive to a playing piece falling onto at least one scoring bar.

13. A method according to claim 8 wherein the at least one playing piece comprises spaced apart members connected by a flexible tether.

14. A method according to claim 13 wherein at least one of the spaced apart members comprises a ball.

* * * * *